US009298149B2

(12) United States Patent
Nakashima

(10) Patent No.: US 9,298,149 B2
(45) Date of Patent: Mar. 29, 2016

(54) IMAGE FORMING APPARATUS THAT PERFORMS COLOR MISALIGNMENT CORRECTION

(71) Applicant: CANON KABUSHIKI KAISHA, Tokyo (JP)

(72) Inventor: Satoshi Nakashima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 14/068,459

(22) Filed: Oct. 31, 2013

(65) Prior Publication Data

US 2014/0169842 A1 Jun. 19, 2014

(30) Foreign Application Priority Data

Dec. 13, 2012 (JP) ..... 2012-272469

(51) Int. Cl.
*G03G 15/01* (2006.01)
*G03G 15/00* (2006.01)

(52) U.S. Cl.
CPC ..... *G03G 15/5058* (2013.01); *G03G 15/0189* (2013.01)

(58) Field of Classification Search
CPC ..... G03G 2215/0161; G03G 2215/0158; G03G 15/5058; G03G 15/0189
USPC ..... 399/301, 49, 72
See application file for complete search history.

(56) References Cited

U.S. PATENT DOCUMENTS

| | | | | |
|---|---|---|---|---|
| 7,257,358 | B2 * | 8/2007 | Overall et al. | 399/301 |
| 2008/0170892 | A1 * | 7/2008 | Park | 399/301 |
| 2012/0003016 | A1 * | 1/2012 | Uchiyama et al. | 399/301 |
| 2012/0148315 | A1 | 6/2012 | Nakashima | |
| 2013/0272731 | A1 | 10/2013 | Tsuruya | |

FOREIGN PATENT DOCUMENTS

| | | | |
|---|---|---|---|
| JP | 7-66953 | A | 3/1995 |
| JP | 2001-356542 | A | 12/2001 |
| JP | 2005-292735 | A | 10/2005 |
| JP | 2011-203320 | A | 10/2011 |
| JP | 2012-141587 | A | 7/2012 |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a process unit configured to act on a photosensitive member, detecting unit configured to detect a latent image formed on the photosensitive member, and a color misalignment correcting unit configured to perform color misalignment correction based on time information obtained by detecting, by the detecting unit, a detection pattern including a plurality of latent image marks for color misalignment correction. In addition, a storage unit stores a weighting coefficient of each latent image mark. The color misalignment correcting unit is further configured to weight the time information by using the corresponding weighting coefficient and perform color misalignment correction.

15 Claims, 16 Drawing Sheets

FIG. 14

| LATENT IMAGE MARK | m1 | m2 | m3 | m4 | m5 | m6 | m7 | m8 | m9 | m10 | m11 | m12 |
|---|---|---|---|---|---|---|---|---|---|---|---|---|
| WEIGHTING COEFFICIENT | 1 | 2 | 1 | 1 | 2 | 1 | 1 | 2 | 1 | 1 | 2 | 1 |
| STANDARDIZED WEIGHTING COEFFICIENT | 1/32 | 2/32 | 1/32 | 1/32 | 2/32 | 1/32 | 1/32 | 2/32 | 1/32 | 1/32 | 2/32 | 1/32 |
| LATENT IMAGE MARK | m13 | m14 | m15 | m16 | m17 | m18 | m19 | m20 | m21 | m22 | m23 | m24 |
| WEIGHTING COEFFICIENT | 1 | 2 | 1 | 1 | 2 | 1 | 1 | 2 | 1 | 1 | 2 | 1 |
| STANDARDIZED WEIGHTING COEFFICIENT | 1/32 | 2/32 | 1/32 | 1/32 | 2/32 | 1/32 | 1/32 | 2/32 | 1/32 | 1/32 | 2/32 | 1/32 |

FIG. 15

| LATENT IMAGE MARK IN WHICH NOISE HAS OCCURRED | OVERLAPPING LATENT IMAGE MARK | NON-OVERLAPPING LATENT IMAGE MARK |
|---|---|---|
| DETECTION ERROR | Δ/16 | Δ/32 |
| PROBABILITY OF OCCURRENCE | 8/24 = 33.33% | 16/24 = 66.67% |

IMAGE FORMING APPARATUS THAT PERFORMS COLOR MISALIGNMENT CORRECTION

BACKGROUND OF THE INVENTION

1. Field of the Invention

The present disclosure relates to an electrophotographic type image forming apparatus.

2. Description of the Related Art

Among electrophotographic type image forming apparatuses, so-called tandem type image forming apparatuses are known in which image forming units of different colors are independently provided. Such a tandem type image forming apparatus has a configuration in which images of different colors are sequentially transferred from the image forming units of different colors onto an intermediate transfer belt, and then collectively transferred from the intermediate transfer belt onto a printing medium.

In this image forming apparatus, due to mechanical factors in the image forming units of different colors, color misalignment (position shift) occurs when the images are overlaid. In particular, in a configuration in which each image forming unit includes a photosensitive member and a scanner unit that exposes the photosensitive member to light, constant color misalignment (hereinafter referred to as "DC color misalignment") occurs due to individual differences in the image forming units. In order to correct the DC color misalignment, the image forming apparatus performs color misalignment correction control. To be specific, a detection developer image (hereinafter referred to as a "detection pattern") for detecting the position of each color is formed on an image carrier such as the intermediate transfer belt, and the relative position of the detection pattern of each color is detected by an optical sensor, whereby the amount of color misalignment is detected and corrected.

Meanwhile, periodic speed variation occurs in the photosensitive member due to eccentricity of rollers that drive the photosensitive member and the intermediate transfer belt, or other causes. Non-constant color misalignment (hereinafter referred to as "AC color misalignment") occurs due to the speed variation. The AC color misalignment generates an error in the amount of color misalignment detected in the detection pattern during color misalignment correction control. Under these circumstances, Japanese Patent Laid-Open No. 2001-356542 proposes that detection patterns be arranged at an interval of an integer fraction of the period of the speed variation that is a cause of the AC color misalignment, the number of detection patterns corresponding to the integer. In Japanese Patent Laid-Open No. 2001-356542, color misalignment correction control is performed by averaging the detection results obtained from the thus-formed detection patterns.

Also, during the color misalignment correction control, electrical noise may occur, causing an error in the results of detection of the detection patterns. Furthermore, if an impact or the like occurs due to the operation of the mechanical mechanism in the image forming apparatus while the detection patterns are formed, the positions of the formed detection patterns are shifted. This also causes an error in the results of detection of the detection patterns. Hereinafter, a detection error caused by electrical noise during color misalignment correction control or by an impact or the like of the mechanical mechanism will be simply referred to as "noise". In order to increase noise resistance during color misalignment correction control, increasing the number of detection patterns is effective.

However, there are cases where the number of patches cannot be increased freely due to a constraint in the arrangement of patches that are developer images constituting detection patterns. Hereinafter, the constraint will be described with reference to FIG. 16.

If, for example, it is assumed that the entire length of the intermediate transfer belt is 600 (mm) and four colors are used in image formation, a requirement is imposed that the maximum length of a detection pattern of a single color is 150 (mm). The detection patterns of different colors each include a plurality of patches. However, if the interval between patches is too short, the accuracy of detection deteriorates. Accordingly, in this case, a requirement is added that, for example, the minimum interval between patches is 15 (mm). As shown in FIG. 16, it is assumed that the length of one period of speed variation that can cause AC color misalignment is 100 (mm), and the maximum value of detection error caused by the speed variation is ΔA. Furthermore, as shown in FIG. 16, it is assumed that noise that causes a detection error ΔB occurs. A detection pattern #1 shown in FIG. 16 is a pattern in which patches are arranged at an equal interval over one period of speed variation while satisfying the requirement that the minimum interval is 15 (mm) in order to reduce the detection error due to AC color misalignment. Specifically, six patches y1 to y6 are arranged at intervals of 100/6=16.67 (mm).

The amount of color misalignment is determined by averaging the detection position or time of each patch, but in the detection pattern #1, the patches are formed over one period of speed variation, and thus the detection error due to the speed variation is cancelled out and is therefore zero. On the other hand, the detection error caused by noise only affects one patch at most, and thus becomes smaller as the number of patches in the detection pattern increases. To be specific, in the detection pattern #1, the detection error caused by noise is ΔB/6. Here, in order to increase the resistance to noise, a case is considered as in a detection pattern #2 in which an increased number of patches are arranged at the same patch interval as that of the detection pattern #1. In the detection pattern #2, three patches y7 to y9 are added at the same patch interval as that of the detection pattern #1.

In the detection pattern #2, the detection error caused by noise is ΔB/9, which is smaller than that of the detection pattern #1. However, the length of the detection pattern #2 is not an integer multiple of the period of speed variation. Here, if the detection error in the amount of color misalignment due to speed variation when the detection pattern #2 is used is determined as (ΔA×2/9) through numerical calculation, the result is worse than that of the detection pattern #1. As described above, when the number of patches is increased in order to improve noise resistance, the detection error due to an AC component may increase. In order to suppress the detection error caused by noise without increasing the detection error due to an AC component, for example, formation of a detection pattern over two periods of speed variation may be conceived, specifically, in the example shown in FIG. 16, formation of a detection pattern so as to have a length of 200 (mm). However, in this example, the maximum length of a detection pattern of a single color is 150 (mm), and thus such a configuration is not possible.

SUMMARY OF THE INVENTION

According to an aspect of the present invention, an image forming apparatus includes: a photosensitive member; a process unit configured to act on the photosensitive member; a forming unit configured to form a detection pattern including a plurality of latent image marks that are electrostatic latent images for color misalignment correction on the photosensitive member; a detecting unit configured to detect the electrostatic latent image formed on the photosensitive member; a color misalignment correcting unit configured to perform color misalignment correction based on time information obtained by detecting, by the detecting unit, the detection pattern including the plurality of latent image marks that are electrostatic latent images for color misalignment correction; and a storage unit configured to store a weighting coefficient of each latent image mark of the detection pattern. The color misalignment correcting unit is further configured to weight the time information by using the corresponding weighting coefficient and perform color misalignment correction.

Further features of the present invention will become apparent from the following description of exemplary embodiments with reference to the attached drawings.

BRIEF DESCRIPTION OF THE DRAWINGS

FIG. 14 depicts a diagram showing weighting coefficients according to one embodiment;

FIG. 15 depicts a diagram showing detection errors according to one embodiment.

DESCRIPTION OF THE EMBODIMENTS

Hereinafter, an exemplary embodiment of the present invention will be described with reference to the drawings. It is to be understood that the following embodiment is merely exemplary, and therefore is not intended to limit the scope of the present invention. Also, in the diagrams described below, constituent elements that are not necessary to describe the embodiment are not illustrated.

First Embodiment

Figure 1:
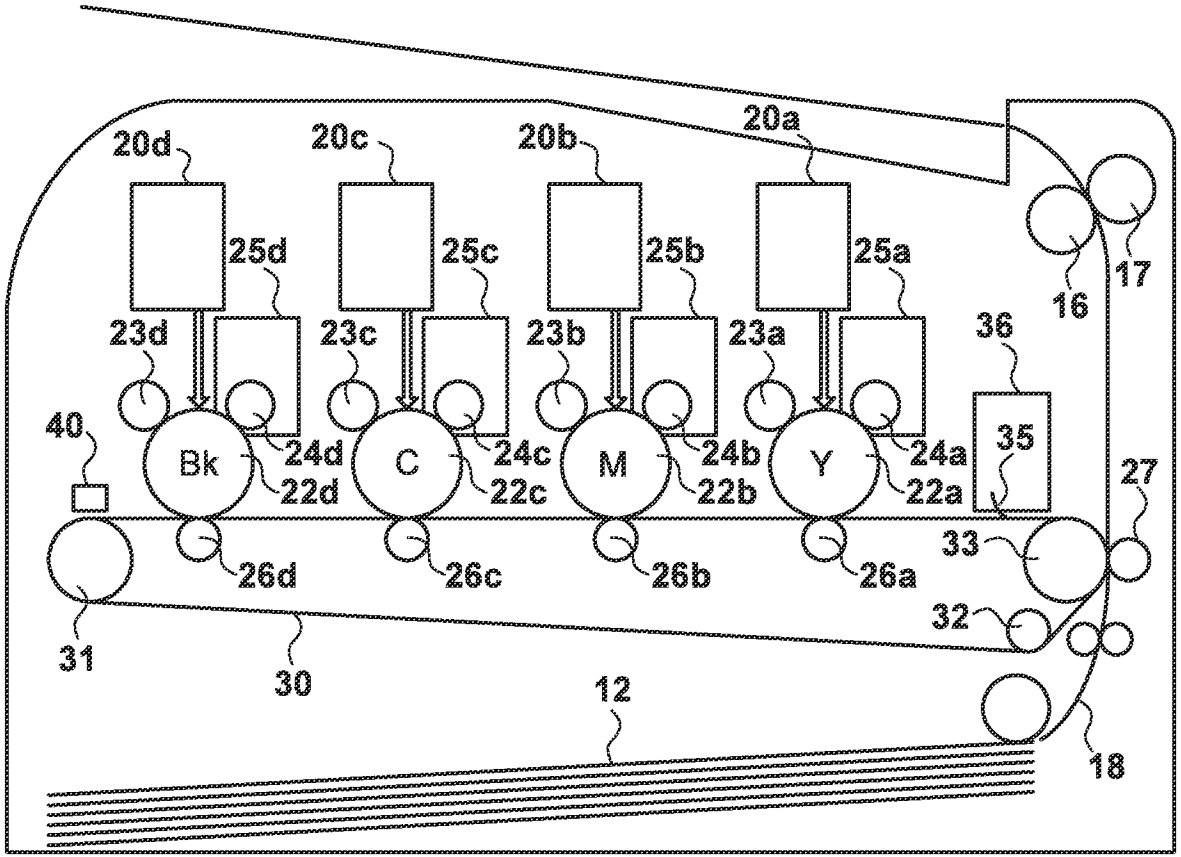
FIG. 1 depicts a schematic configuration of an image forming apparatus according to one embodiment.

FIG. 1 is a diagram showing the configuration of image forming units of an image forming apparatus according to the present embodiment. Note that the letters a, b, c and d at the end of reference numerals respectively indicate that the members are for forming developer images of yellow (Y), magenta (M), cyan (C) and black (Bk). Also, where it is unnecessary to distinguish between colors, reference numerals without the letters a, b, c and d at the end are used. A photosensitive member 22 is an image carrier and is rotationally driven. A charging roller 23 charges the surface of the photosensitive member 22 of the corresponding color to a uniform potential. As an example, the charging bias output by the charging roller 23 is −1200 V, and the surface of the photosensitive member 22 is thereby charged to a potential of −700 V (dark potential). A scanner unit 20 forms an electrostatic latent image on the photosensitive member 22 by scanning the surface of the photosensitive member 22 so as to expose the surface of the photosensitive member 22 to laser light according to the image data of the image to be formed. As an example, the potential of the area where the electrostatic latent image is formed through exposure to laser light is −100 V (light potential). A developing unit 25 has developing material of the corresponding color, and develops the electrostatic latent image on the photosensitive member 22 by supplying the developing material to the electrostatic latent image on the photosensitive member 22 by using a developing sleeve 24. As an example, the developing bias output by the developing sleeve 24 is −350 V, and at this potential, the developing unit 25 causes the developing material to adhere to the electrostatic latent image. A primary transfer roller 26 transfers a developer image formed on the photosentive member 22 onto an intermediate transfer belt 30 that is an image carrier and rotationally driven by rollers 31, 32 and 33. As an example, the primary transfer bias output by the primary transfer roller 26 is +1000 V, and at this potential, the primary transfer roller 26 transfers the developing materials onto the intermediate transfer belt 30. At this time, the developer image of each photosensitive member 22 is overlaid and transferred onto the intermediate transfer belt 30, and thereby a color image is formed.

A secondary transfer roller 27 transfers the developer image on the intermediate transfer belt 30 onto a printing medium 12 conveyed through a conveyance path 18. A pair of fixing rollers 16 and 17 thermally fix the developer image transferred onto the printing medium 12. Here, the developing material not transferred from the intermediate transfer belt 30 onto the printing medium 12 by the secondary transfer roller 27 is collected in a container 36 by a cleaning blade 35. Also, a detection sensor 40 is provided at a position opposing the intermediate transfer belt 30 in order to perform conventional color misalignment correction control by forming developer images.

The scanner unit 20 may be configured to expose the photosensitive member 22 to an LED array or the like, instead of laser. Also, instead of providing the intermediate transfer belt 30, the image forming apparatus may be configured such that the developer image on each photosensitive member 22 is transferred directly onto the printing medium 12.

Figure 2A:
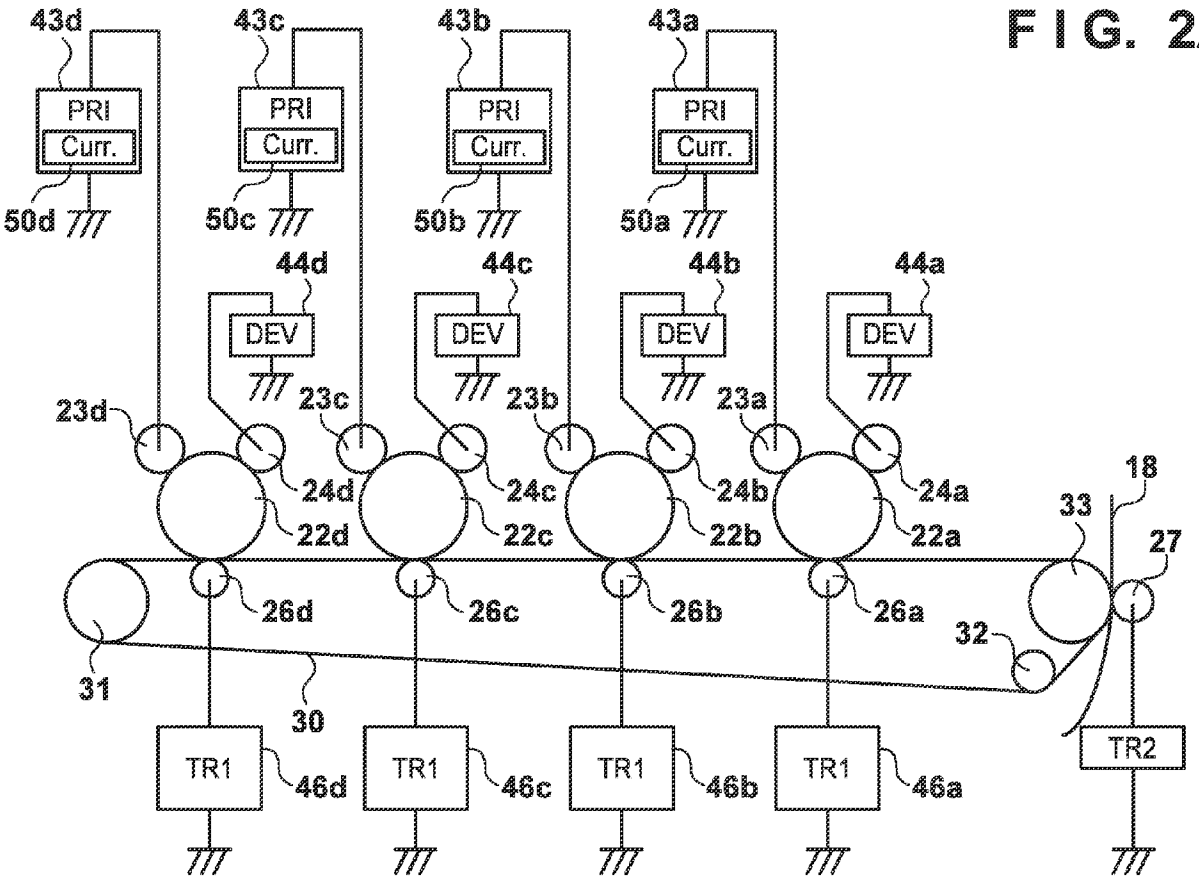
FIGS. 2A and 2B depict a system for supplying high voltage power to image forming units according to one embodiment.

FIG. 2A is a diagram showing a system for supplying high voltage power to each processing unit of the image forming unit. As used herein, the processing unit is a member that acts on the photosensitive member 22 so as to perform image formation and includes one of the charging roller 23, the developing unit 25 and the primary transfer roller 26. A charging high voltage power supply circuit 43 applies a voltage to its corresponding charging roller 23. Also, a developing high voltage power supply circuit 44 applies a voltage to the developing sleeve 24 of its corresponding developing unit 25. Furthermore, a primary transfer high voltage power supply circuit 46 applies a voltage to its corresponding primary transfer roller 26. In this way, the charging high voltage power supply circuit 43, the developing high voltage power supply circuit 44 and the primary transfer high voltage power supply circuit 46 function as a voltage applying unit for the processing units.

Figure 2B:
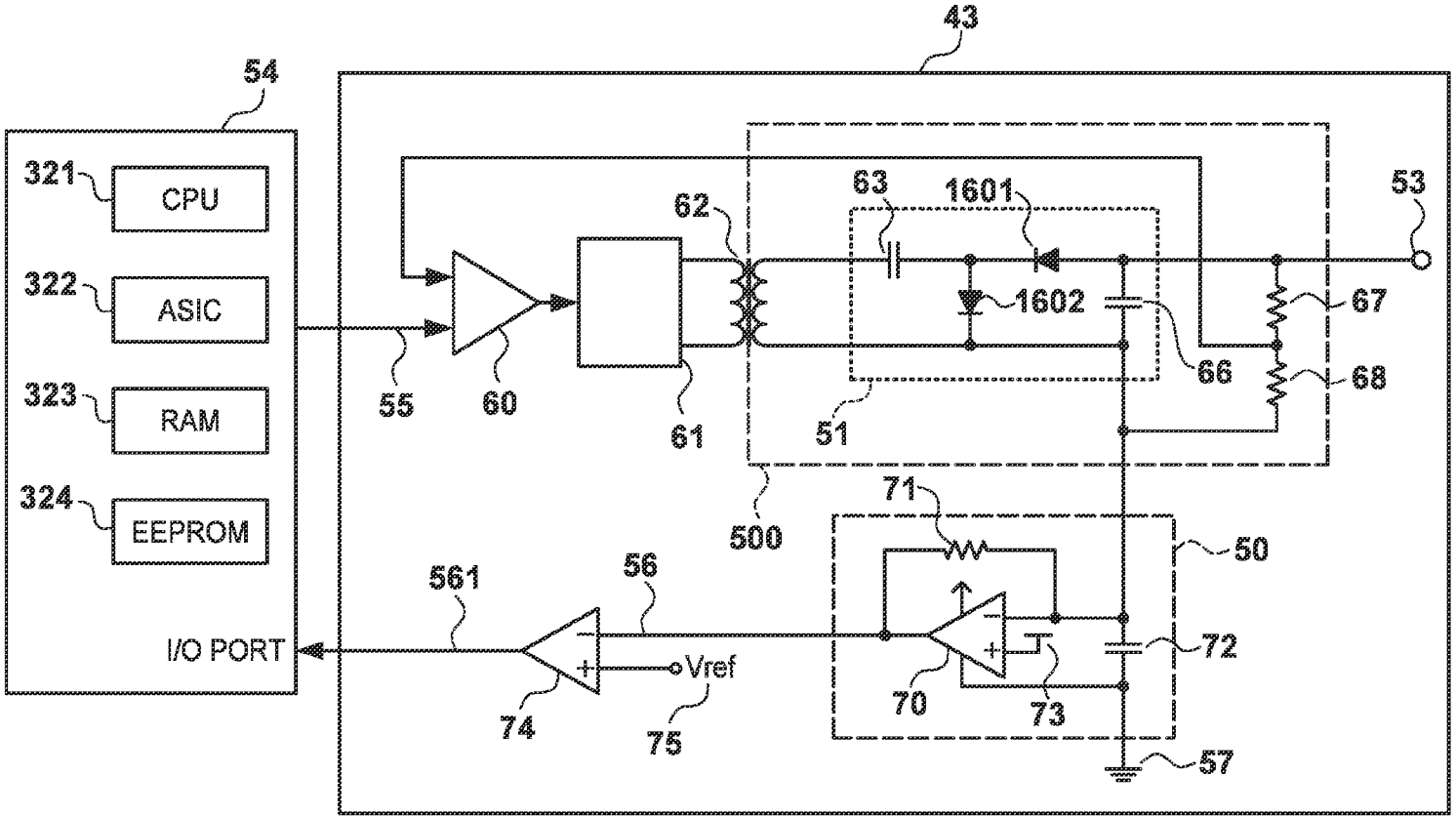

Next is a description of the charging high voltage power supply circuit 43 according to the present embodiment with reference to FIG. 2B. A transformer 62 boosts a voltage of an alternating current signal generated by a driving circuit 61 to a several 10-times amplitude. A rectifier circuit 51 including diodes 1601 and 1602 and capacitors 63 and 66 rectifies and smoothes the boosted alternating current signal. The rectified and smoothed signal is then output from an output terminal 53 to the charging roller 23 as a direct current voltage. An operational amplifier 60 controls an output voltage of the driving circuit 61 such that a voltage obtained by dividing the voltage of the output terminal 53 by detection resistors 67 and 68 is equal to a set voltage value 55 set by an engine control unit 54. Then, according to the voltage of the output terminal 53, current flows via the charging roller 23, the photosensitive member 22 and a ground.

A current detecting circuit 50 is provided to output a detection voltage 56 according to this current. The detection voltage 56 is input to a negative input terminal of a comparator 74. A reference voltage 75 is input to a positive input terminal of the comparator 74. The comparator 74 outputs, to the engine control unit 54, a binary voltage 561 according to the magnitudes of the detection voltage 56 and the reference voltage 75. To be specific, the comparator 74 is set to "High" when the detection voltage 56 falls below the reference voltage 75, and otherwise is set to "Low".

As will be described later, in the present embodiment, color misalignment correction is performed by using latent image marks that are electrostatic latent images for color misalignment correction and are formed on the photosensitive member 22. While a latent image mark passes through the position of the charging roller 23, the current flowing via the charging roller 23, the photosensitive member 22 and the ground increases, and the detection voltage 56 decreases as compared to that at the other times. This will also be described later. The reference voltage 75 that is a threshold value is set to a value between the detection voltage 56 when there is no latent image mark and a minimum value when a latent image mark passes through the position of the charging roller 23 so that the passage of the latent image mark can be detected. With this configuration, when a latent image mark passes through the position of the charging roller 23, the comparator 74 outputs, to the engine control unit 54, the binary voltage 561 having one rising edge and one falling edge following the rising edge. The engine control unit 54 defines, for example, the midpoint between the rising edge and the falling edge of the binary voltage 561 as a detection position of the latent image mark. The engine control unit 54 may be configured to detect only either one of the rising edge and the falling edge of the binary voltage 561 and define it as a detection position of the latent image mark.

Next is a description of the current detecting circuit 50 shown in FIG. 2B. The current detecting circuit 50 is interposed between a secondary-side circuit 500 of the transformer 62 and a ground point 57. By outputting a desired voltage to the output terminal 53, current flows into the current detecting circuit 50 via the photosensitive member 22, the charging roller 23 and the ground point 57. An inverting input terminal of an operational amplifier 70 is connected to an output terminal thereof via a resistor 71. Accordingly, at the output terminal of the operational amplifier 70, the detection voltage 56, which is an output value proportional to the amount of current flowing through the output terminal 53, appears. A capacitor 72 is provided to stabilize the inverting input terminal of the operational amplifier 70.

The engine control unit 54 performs overall control on the operations of the image forming apparatus. A CPU 321 uses a RAM 323 as a main memory and a work area, and controls image formation in accordance with various types of control programs stored in an EEPROM 324. Also, an ASIC 322 performs various types of control such as, for example, control of each motor, and control of high voltage power supply control of developing bias in accordance with instructions from the CPU 321 during image formation. Note that some or all of the functions of the CPU 321 may be performed by the ASIC 322. Alternatively, some or all of the functions of the ASIC 322 may be performed by the CPU 321. Also, some of the functions of the engine control unit 54 may be performed by hardware serving as another control unit.

There is no limitation on the form of hardware to implement the functions described here, and any of the CPU 321, the ASIC 322 and other hardware can be operated. Also, processing may be allocated to each hardware device at a given ratio.

Figure 3:
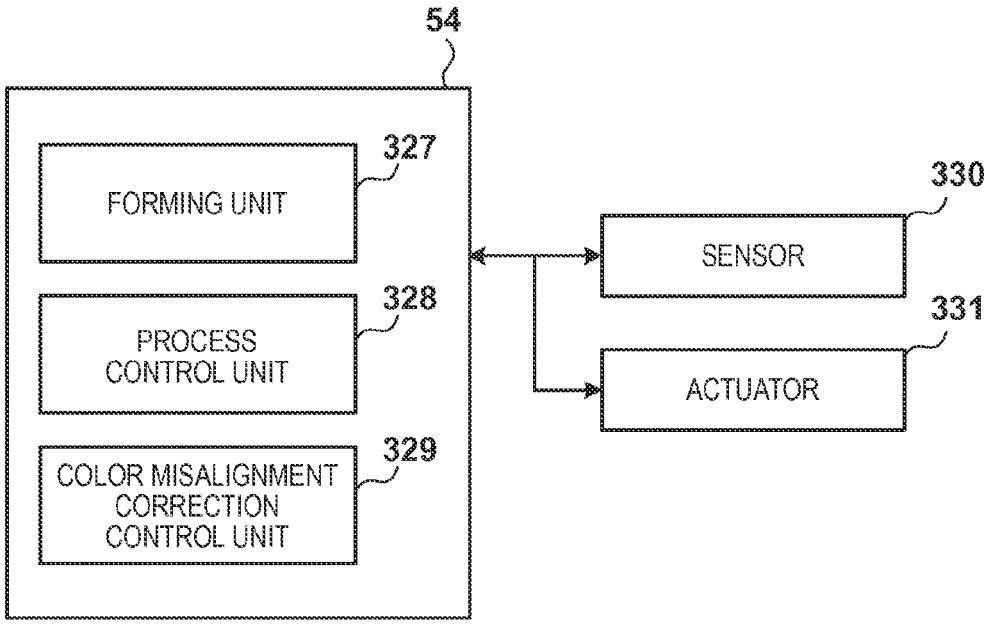
FIG. 3 depicts a functional block diagram of an engine control unit according to one embodiment.

Operations of the engine control unit 54 will be described next with reference to FIG. 3. An actuator 331 shown in FIG. 3 collectively represents actuators including a driving motor of the photosensitive member 22, a separation motor of the developing unit 25 and the like. Also, a sensor 330 shown in FIG. 3 collectively represents sensors including a registration sensor, the current detecting circuit 50 and the like. The engine control unit 54 performs various types of processing based on information acquired from each sensor 330. The actuator 331 functions as, for example, a driving source for driving a cam for detaching the developing sleeve 24 from the photosensitive member 22, which will be described later.

A forming unit 327 controls the scanner unit 20 so as to form latent image marks (described later) on the photosensitive member 22, which will be described later. The forming unit 327 also performs processing for forming a developer image for color misalignment correction on the intermediate transfer belt 30, which will be described later. A process control unit 328, as will be described later, controls operations and settings of each processing unit during detection of latent image marks. A color misalignment correction control unit 329 calculates the amount of color misalignment from the time of detection of the binary voltage 561 by using a calculation method described later, and reflects the amount of color misalignment.

Hereinafter, an overview of color misalignment correction control according to the present embodiment will be described. First, the engine control unit 54 forms a detection pattern for color misalignment correction, which is a developer image, on the intermediate transfer belt 30, measures a relative position of each other color with respect to the reference color by using the detection sensor 40, and determines the amount of color misalignment. Then, the engine control unit 54 adjusts an image forming condition such that the determined amount of color misalignment is reduced. Specifically, the engine control unit 54 adjusts, for example, the timing at which the scanner unit 20 irradiates the photosensitive member 22 with laser light.

In a state in which color misalignment is small after the color misalignment correction using the developer image, the photosensitive member 22 acquires a reference value for color misalignment correction using latent image marks. To be specific, a plurality of latent image marks are formed on each photosensitive member 22, and the time when a formed latent image mark arrives at the position of the charging roller 23 is determined by using the detection voltage 56 so as to obtain a reference value. After that, in the case of color misalignment correction control performed when there is a change in the internal temperature of the apparatus due to continuous printing or the like, the amount of color misalignment is determined based on the formed latent image marks and the reference value, and then color misalignment correction is performed. Hereinafter, color misalignment correction is assumed to be performed by controlling the laser light irradiation timing. However, it is also possible to, for example, control the speed of the photosensitive member 22, or control the mechanical position of a reflective mirror in the scanner unit 20.

Figure 4:
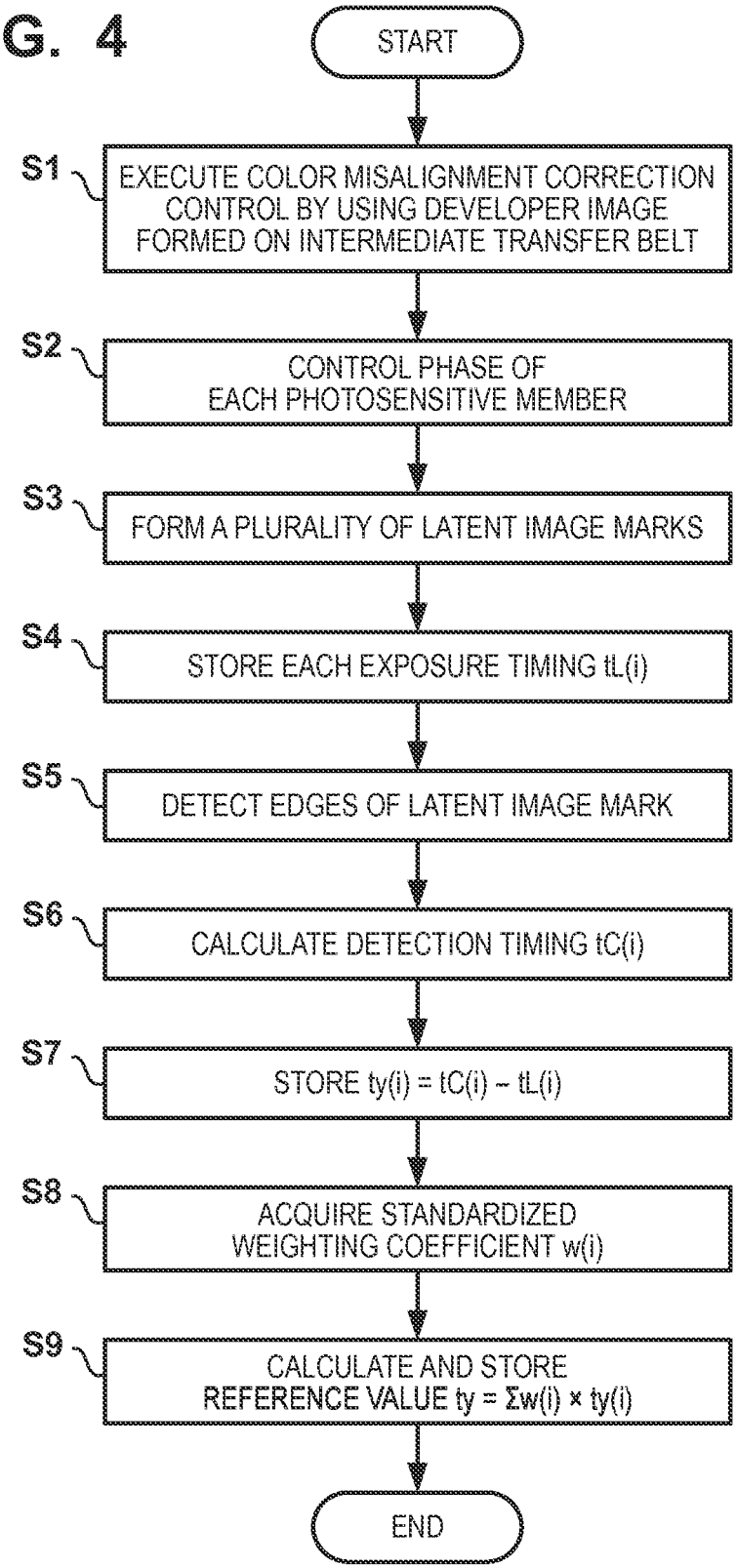
FIG. 4 depicts a flowchart of reference value acquiring processing according to one embodiment.
Figure 5A:
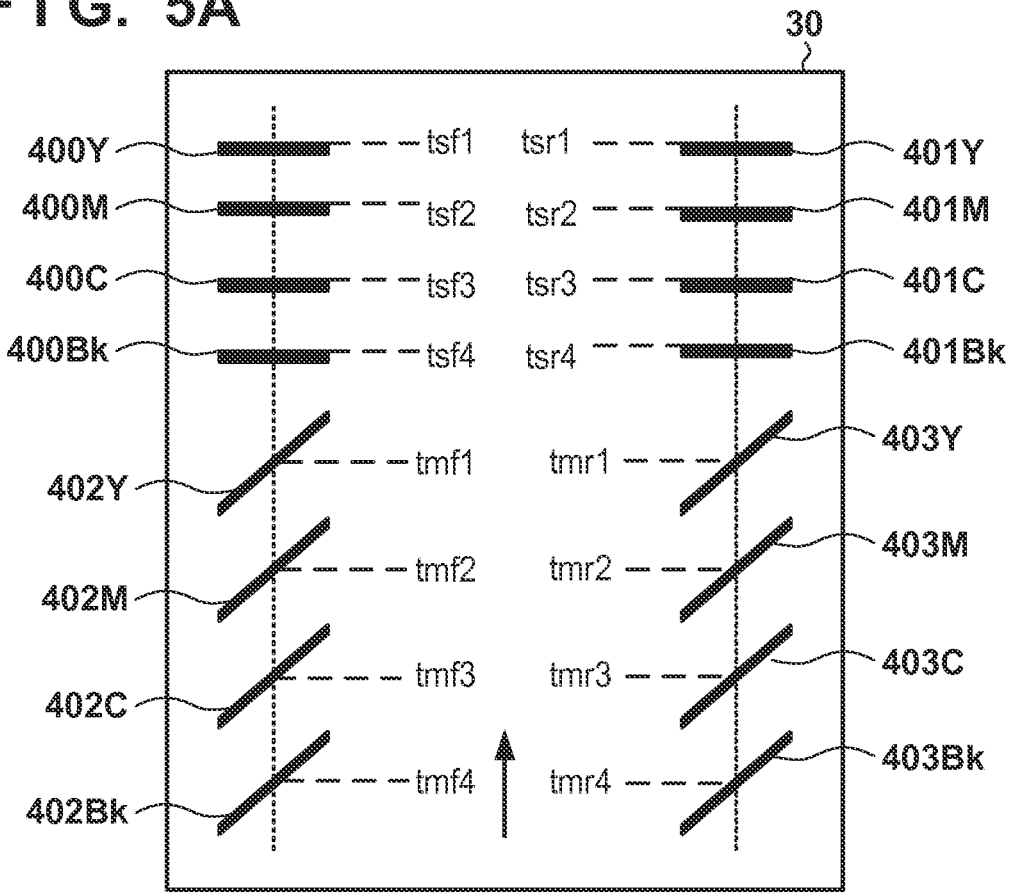
FIGS. 5A and 5B depict diagrams showing detection patterns for color misalignment correction and a latent image mark according to one embodiment.

The color misalignment correction control will be described below in detail with reference to FIG. 4. The processing shown in FIG. 4 other than step S1 is performed independently for each color. In step S1 shown in FIG. 4, the engine control unit 54 forms a detection pattern, which is a developer image for detecting color misalignment, on the intermediate transfer belt 30. FIG. 5A shows an example of a detection pattern. In FIG. 5A, marks 400 and 401 are patterns for detecting the amount of color misalignment in a moving direction (sub-scanning direction) of the intermediate transfer belt 30. Marks 402 and 403 are patterns for detecting the amount of color misalignment in a main-scanning direction that is perpendicular to the moving direction of the intermediate transfer belt 30. An arrow in FIG. 5A indicates the direction in which the intermediate transfer belt 30 moves, which corresponds to the sub-scanning direction. In the example of FIG. 5A, the marks 402 and 403 are inclined by 45 degrees with respect to the main-scanning direction. Note that the letters Y, M, C and Bk at the end of the reference numerals of the marks 400 to 403 indicate that the corresponding marks are formed with developing materials of yellow, magenta, cyan and black, respectively. Likewise, tsf1 to tsf4, tmf1 to tmf4, tsr1 to tsr4, and tmr1 to tmr4 assigned to the marks indicate detection timings of the corresponding marks detected by the detection sensor 40. Detection of these marks by the detection sensor 40 can be performed by using a known technique such as, for example, using reflective light when the marks are irradiated with light.

An example will be described below in which the reference color is yellow, and the position of magenta is corrected. However, the same applies to correction of the positions of the other colors such as cyan and black. Here, it is assumed that the moving speed of the intermediate transfer belt 30 is v (mm/s), and the theoretical distance between yellow marks 400 and 401 and the theoretical distance between magenta marks 400 and 401 are dsM. In this case, the amount of color misalignment δesM of magenta in the sub-scanning direction can be represented by the following equation:

$$\delta esM = v \times \{(tsf2 - tsf1) + (tsr2 - tsr1)\}/2 - dsM.$$

Also, with respect to the main-scanning direction, for example, the amount of color misalignment δemfM of magenta on the left side can be represented by the following equation:

$$\delta emfM = v \times (tmf2 - tsf2) - v \times (tmf1 - tsf1).$$

The same applies to the amount of color misalignment δemrM of magenta on the right side. The positive and negative signs in δemfM and δemrM indicate shift directions in the main-scanning direction. The engine control unit 54 corrects the start position of the magenta color based on δemfM. Based on δemrM-δemfM, the width in the main-scanning direction, or in other words, the main-scanning magnification is corrected. If there is an error in the main-scanning magnification, the start position is calculated taking into consideration not only δemfM, but also the amount of change in the image frequency (image clock) that has changed by the main-scanning magnification being corrected. The engine control unit 54 changes, for example, the laser light irradiation timing by the scanner unit 20, so as to eliminate the calculated amount of color misalignment. If, for example, the amount of color misalignment in the sub-scanning direction is 4 lines, the engine control unit 54 adjusts the laser light irradiation timing for forming a magenta electrostatic latent image by an amount corresponding to 4 lines. In this way, through the processing of step S1, the subsequent processing, namely, processing for acquiring a reference value can be performed in a state in which the amount of color misalignment is reduced.

Returning to FIG. 4, in step S2, in order to suppress the influence when there are variations in the rotational speed (circumferential speed) of the photosensitive member 22, the engine control unit 54 sets the rotational phase of photosensitive members 22 to a predetermined state. To be specific, under control of the engine control unit 54, the phase of each photosensitive member 22 is adjusted such that the timing for forming a latent image mark on the photosensitive members 22 is the same. In the case where a driving gear is provided to each photosensitive member 22 at its rotation axis, adjustment is performed such that, substantially, the phase relationship of the driving gears of the photosensitive members 22 has a predetermined relationship.

After adjusting the phase of each photosensitive member 22 in step S2, the engine control unit 54 forms a latent image pattern on each photosensitive member 22 in step S3. The latent image pattern is a detection pattern for color misalignment correction and including a plurality of latent image marks. How the latent image marks in a single latent image pattern are determined will be described later. The following description will be given assuming that a single latent image pattern includes 24 latent image marks. When forming the latent image pattern, the developing sleeve 24 is detached from the photosensitive members 22 such that the latent image marks are not developed, and the primary transfer roller 26 is also detached from the photosensitive member 22. With respect to the primary transfer roller 26, the applied voltage may be set to off (zero) so that the action on the photosensitive member 22 is reduced as compared to that during normal image formation. Also, a bias voltage of opposite polarity that is opposite to that normally used may be applied to the developing sleeve 24 so as to prevent adhesion of the developing material. Furthermore, in the case of using a jumping developing method in which the photosensitive member 22 and the developing sleeve 24 are brought into a non-contact state and a voltage is applied by superimposing an alternating current bias on a direct current bias, the application of voltage on the developing sleeve 24 may be simply turned off.

In step S4, the engine control unit 54 calculates an exposure timing tL(i) that is the time at which each latent image mark was formed, and stores the calculated timing in the RAM 323. As used herein, the exposure timing refers to the timing at which the center position of a latent image mark in the sub-scanning direction was formed. To be specific, if it is assumed that the exposure start timing of the i-th latent image mark is tLup(i), and the exposure end timing is tLdown(i), exposure timing tL(i) can be represented by the following equation:

$$tL(i)=(tLup(i)+tLdown(i))/2.$$

Note that tLup(i) and tLdown(i) may be the timings of a rising edge and a falling edge of the laser signal for forming the latent image mark.

Figure 5B:
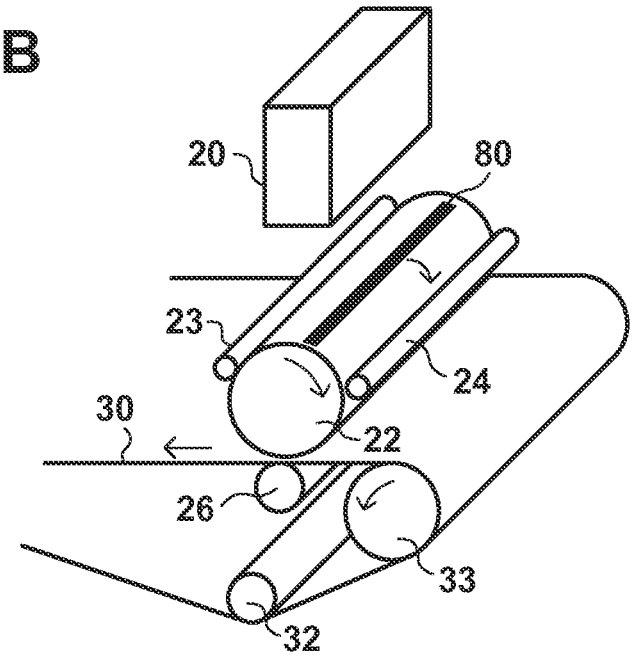

FIG. 5B shows a state in which a latent image mark 80 is formed on the photosensitive member 22. The latent image mark 80 is formed, for example, so as to have a maximum width in the width of the image area in the main-scanning direction and have a length corresponding to approximately 30 scanning lines in the sub-scanning direction. In the main-scanning direction, in order to increase the magnitude of variation in the detection voltage 56 due to the latent image mark 80, latent image mark 80 can be formed so as to have a width more than half the maximum width of the image area. The width of the latent image mark 80 may be increased so as to extend to an area beyond the image area (printing area on the printing medium).

Figure 6A:
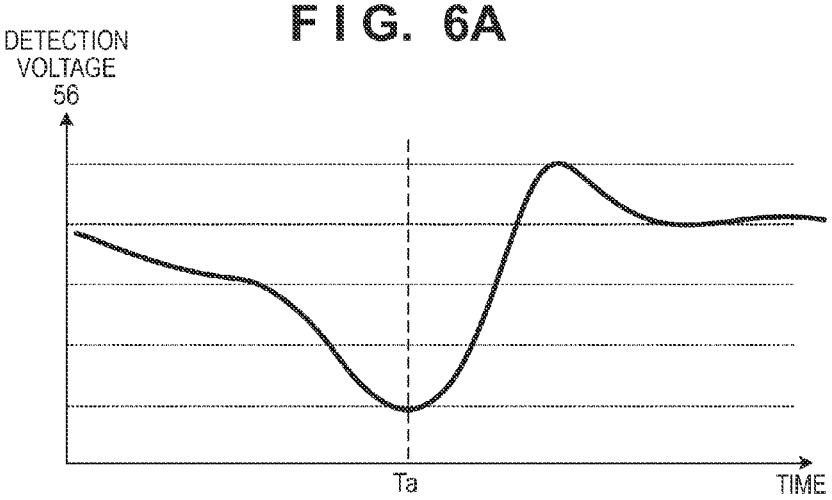
FIGS. 6A to 6C depict illustrative diagrams of latent image mark detection.
Figure 6B:
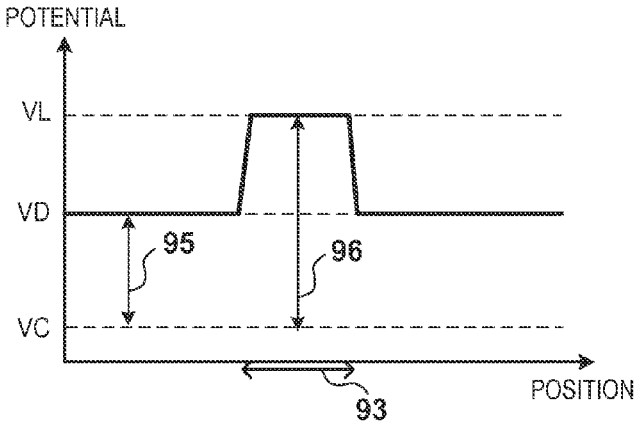
Figure 6C:
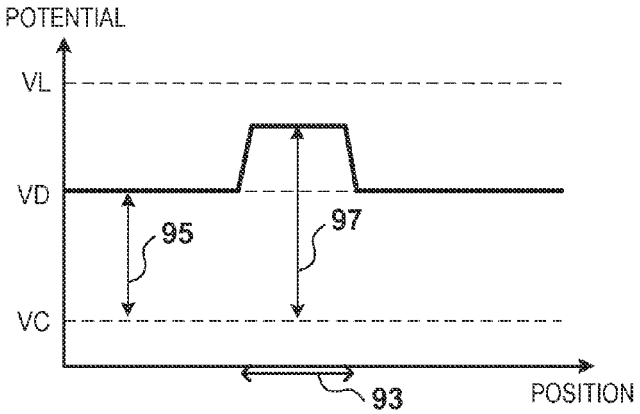

Next, in step S5, the engine control unit 54 detects each edge of each latent image mark 80 formed on each photosensitive member 22 based on the detection voltage 56. FIG. 6A shows variations in the detection voltage 56 with time when the latent image mark 80 reaches the charging roller 23. As shown in FIG. 6A, when the latent image mark 80 passes through a position facing the charging roller 23, the detection voltage 56 temporarily drops accordingly and thereafter returns. The reason that the detection voltage 56 varies as shown in FIG. 6A will now be described. FIGS. 6B and 6C show the surface potentials of the photosensitive member 22 in the case where the latent image mark 80 has no developing material attached thereto and in the case where the latent image mark 80 has a developing material attached thereto. In these diagrams, the horizontal axis indicates the position of the circumferential surface of the photosensitive member 22, and an area 93 indicates the position where the latent image mark 80 is formed. The vertical axis indicates potential. The dark potential of the photosensitive member 22 is indicated by VD (for example, −700 V), the light potential is indicated by VL (for example, −100 V), and the charging bias of the charging roller 23 is indicated by VC (for example, −1000 V).

In the area 93 of the latent image mark 80,potential differences 96 and 97 between the charging roller 23 and the photosensitive member 22 are greater than a potential difference 95 in the other area. Accordingly, when the latent image mark 80 faces the charging roller 23, the value of the current flowing through the charging roller 23 increases. Then, with this increase in the current, the voltage value of the output terminal of the operational amplifier 70 decreases. This is the reason that the detection voltage 56 drops. Thus, the detection voltage 56 indicates the surface potential of the photosensitive member 22. The current path between the charging roller 23 and the photosensitive member 22 can be either one or both of a path routed via a nip portion between the charging roller 23 and the photosensitive member 22 and a path due to discharge near the nip portion, but actual path is not important. Also, as is clear from FIG. 6C, even if the latent image mark 80 has a developing material attached thereto, the position of the latent image mark 80 can be detected by using the detection voltage 56. In other words, at the position of the charging roller 23, the latent image mark 80 may be in a developed state, and detecting a latent image mark 80 encompasses a situation in which a developed latent image mark 80 is detected.

The detection voltage 56 temporarily drops due to the latent image mark 80, but returns to its original value. Accordingly, the comparator 74 shown in FIG. 2B outputs two edges, namely, a rising edge and a falling edge when a single latent image mark 80 passes. Therefore, when 24 latent image marks 80 are formed for each color, the engine control unit 54 detects 48 edges for each color. Here, if it is assumed that the time of detection of each edge is te(i), the engine control unit 54 calculates a detection timing tC(i) of the i-th (i=1 to 24) latent image mark 80 as follows in step S6 shown in FIG. 4:

$$tC(i)=(te(2i-1)+te(2i))/2.$$

In other words, the detection timing of a latent image mark 80 is the detection timing of the center position of the latent image mark 80.

In step S7, the engine control unit 54 calculates a time interval ty(i) that is time information between the time when the i-th latent image mark 80 is formed and the time when the i-th latent image mark 80 is detected by using the following equation and stores the calculated time interval:

$$ty(i)=tC(i)-tL(i).$$

In step S8, the engine control unit 54 acquires a standardized weighting coefficient w(i) (i=1 to 24) stored in advance in the EEPROM 324. The weighting coefficient will be described later in detail. In step S9, the engine control unit 54 multiplies the time interval ty(i) between formation and detection of each latent image mark by the weighting coefficient w(i) and integrates the result, and then calculates a weighted average value ty of the time interval between formation and detection of all of the latent image marks 80 included in a single latent image pattern by using the following equation:

$$ty=\Sigma w(i)\times ty(i).$$

The engine control unit 54 stores the obtained weighted average value ty in, for example, the EEPROM 324 as a reference value.

Figure 7:
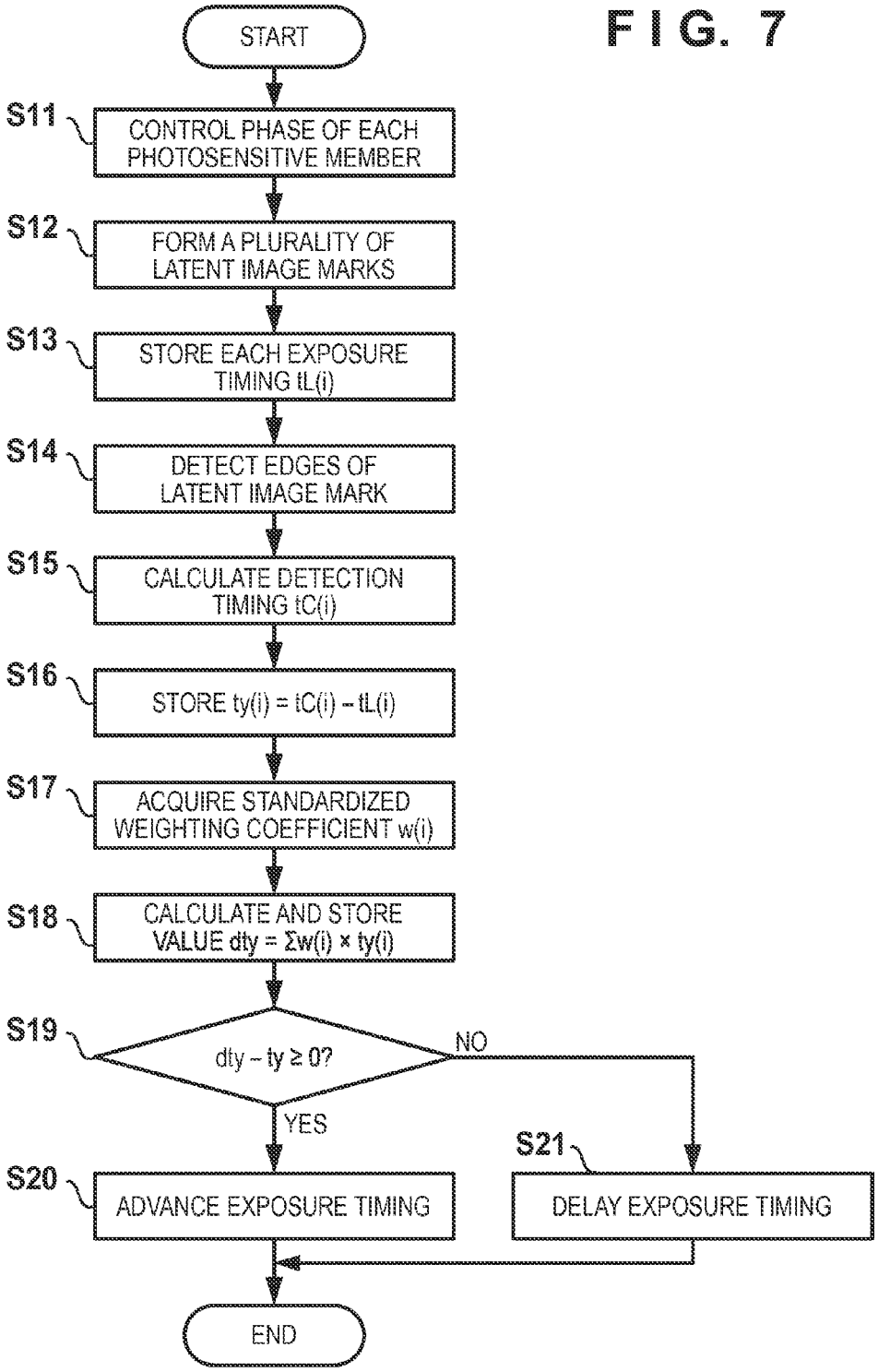
FIG. 7 depicts a flowchart of color misalignment correction control according to one embodiment.

The color misalignment correction control will be described next with reference to FIG. 7. The processing of FIG. 7 is also performed independently for each color. The processing from step S11 to step S18 in FIG. 7 is the same as that from step S2 to step S9 in FIG. 4, and thus descriptions thereof are omitted here. However, note that the value determined in step S18 is defined as dty. In step S19, the engine control unit 54 compares dty obtained in step S18 with the reference value ty obtained in advance through the processing shown in FIG. 4. To be specific, it is determined whether a difference obtained by subtracting the reference value ty obtained in advance through the processing shown in FIG. 4 from dty obtained in step S18 is 0 or greater. If it is determined that the difference is 0 or greater, it means that the average value of the time taken between exposure and detection of the latent image marks 80 lags behind the reference value, and thus in step S20, the engine control unit 54 advances the exposure timing. If, on the other hand, it is determined in step S19 that the difference is less than 0, in step S21, the engine control unit 54 delays the exposure timing. Through the above processing, color misalignment can be corrected. Note that the color misalignment correction control using latent image marks 80 is not limited to the above configuration. It is also possible to, for example, use a configuration in which latent image marks 80 of respective colors are formed simultaneously and the difference in detection timing is checked. As will be understood, if the difference is 0, it means that color misalignment has not actually occurred, and thus it is unnecessary to change the exposure timing.

Figure 8:
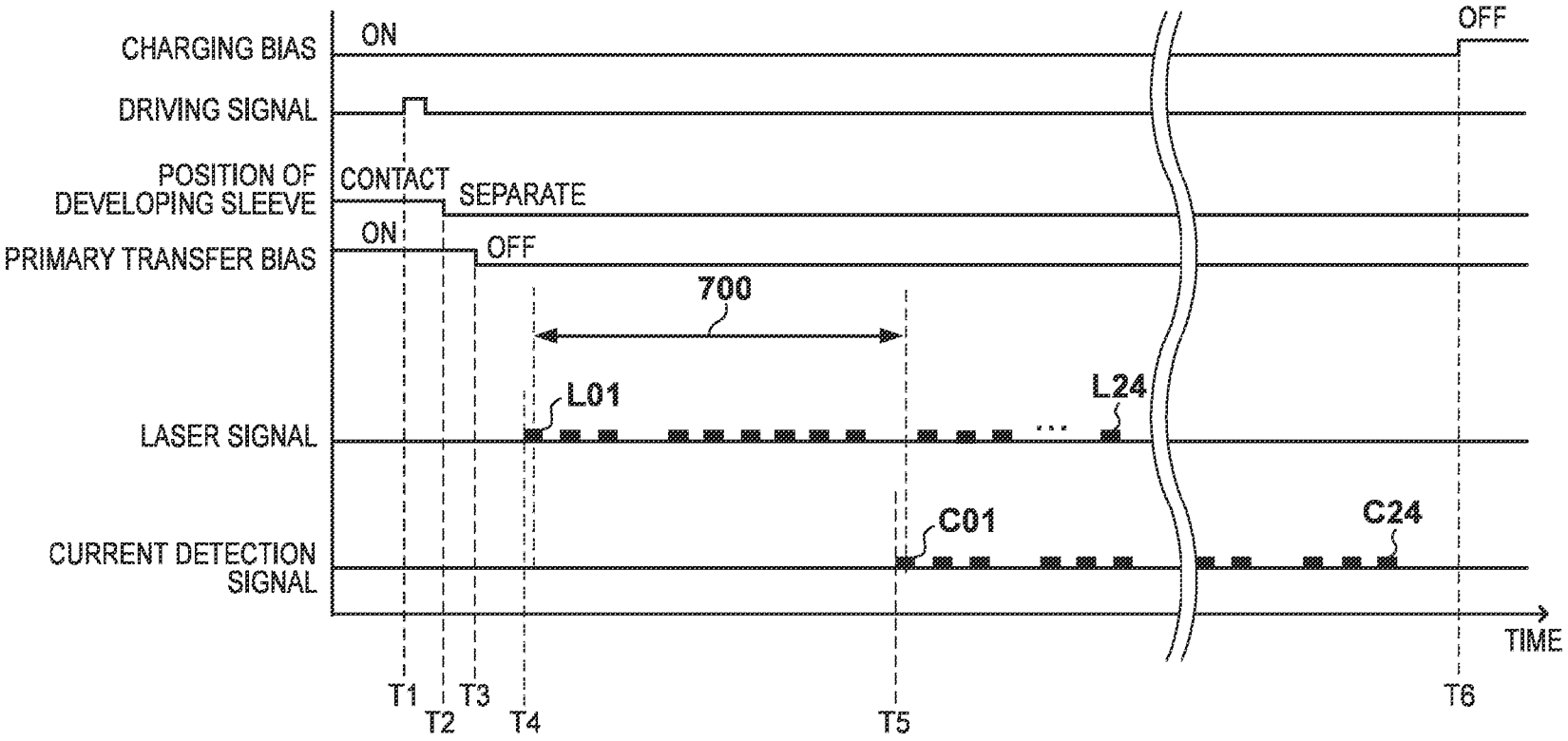
FIG. 8 depicts a timing chart of formation and detection of latent image marks according to one embodiment.

Formation of a latent image pattern will be described next with reference to the timing chart shown in FIG. 8. FIG. 8 shows a sequence for a given single color, but the sequence shown in FIG. 8 is performed for each color. The engine control unit 54 outputs a driving signal for driving a cam for separating the developing sleeve 24 from the photosensitive member 22 at time T1, and separates the developing sleeve 24 from the photosensitive member 22 at time T2. Furthermore, at time T3, the engine control unit 54 performs control so as to turn the primary transfer bias from on to off. It is also possible to, instead of separating the developing sleeve 24 at the time T1, set the output voltage of the developing high voltage power supply circuit 44 to 0. Alternatively, a voltage of opposite polarity that is opposite to that normally used may be applied. Also, the primary transfer roller 26 may be separated from the photosensitive member 22 instead of the primary transfer bias being turned off.

Furthermore, the engine control unit 54 starts formation of a total of 24 latent image marks 80 at time T4. Furthermore, during the period between time T5 and time T6, detection is performed on the total of 24 latent image marks 80 that have been formed. A current detection signal corresponds to the detection voltage 56 or the binary voltage 561. After that, the engine control unit 54 calculates ty(i). For example, ty(1) is a time denoted by a reference numeral 700, which is the difference between the time when the first latent image mark 80 was formed, which is indicated by L01, and the time when the first latent image mark 80 was detected, which is indicated by C01.

Figure 9:
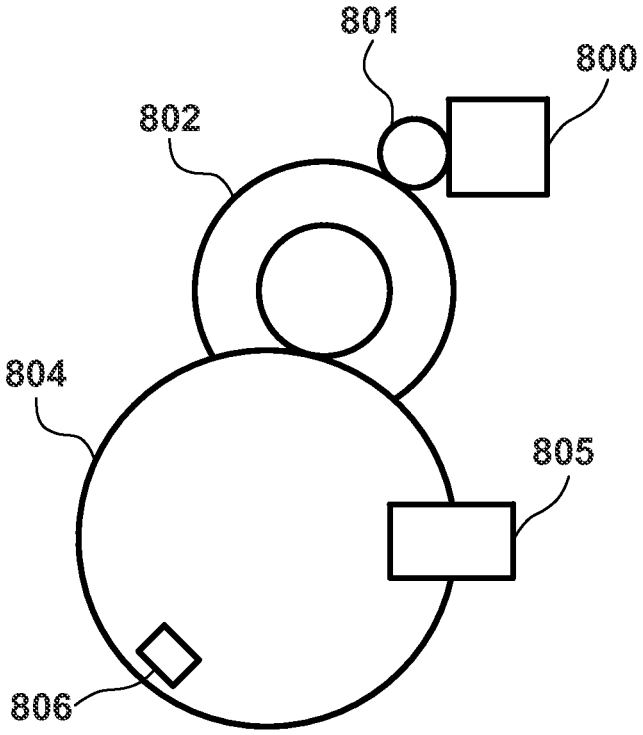
FIG. 9 depicts a diagram showing a driving configuration of a photosensitive member according to one embodiment.

FIG. 9 shows a configuration of a driving unit for driving the photosensitive member 22. A driving motor 800 transfers motive power to a photosensitive member gear 804 via a motor gear 801 and a stepped gear 802. The photosensitive member 22 is arranged coaxially with the photosensitive member gear 804, and is configured to rotate together with the photosensitive member gear 804. The photosensitive member gear 804 is provided with a home position flag 806, and thus the period of one rotation of the photosensitive member 22 can be monitored by a home position sensor 805. For example, with the gears 801 to 804, the rotation of the driving motor 800 is slowed down to one sixteenth to drive the photosensitive member 22.

Hereinafter, a configuration of a latent image pattern according to the present embodiment will be described. First, a detection error due to an AC component that needs to be considered in the present embodiment will be described. As used herein, the AC component means a periodic component that occurs repeatedly such as a sine wave. Each gear shown in FIG. 9 has an eccentricity, and the eccentricity of each gear causes the gear engaging radius to vary, whereby a speed variation occurs in the rotation of the photosensitive member 22.

Figure 10:
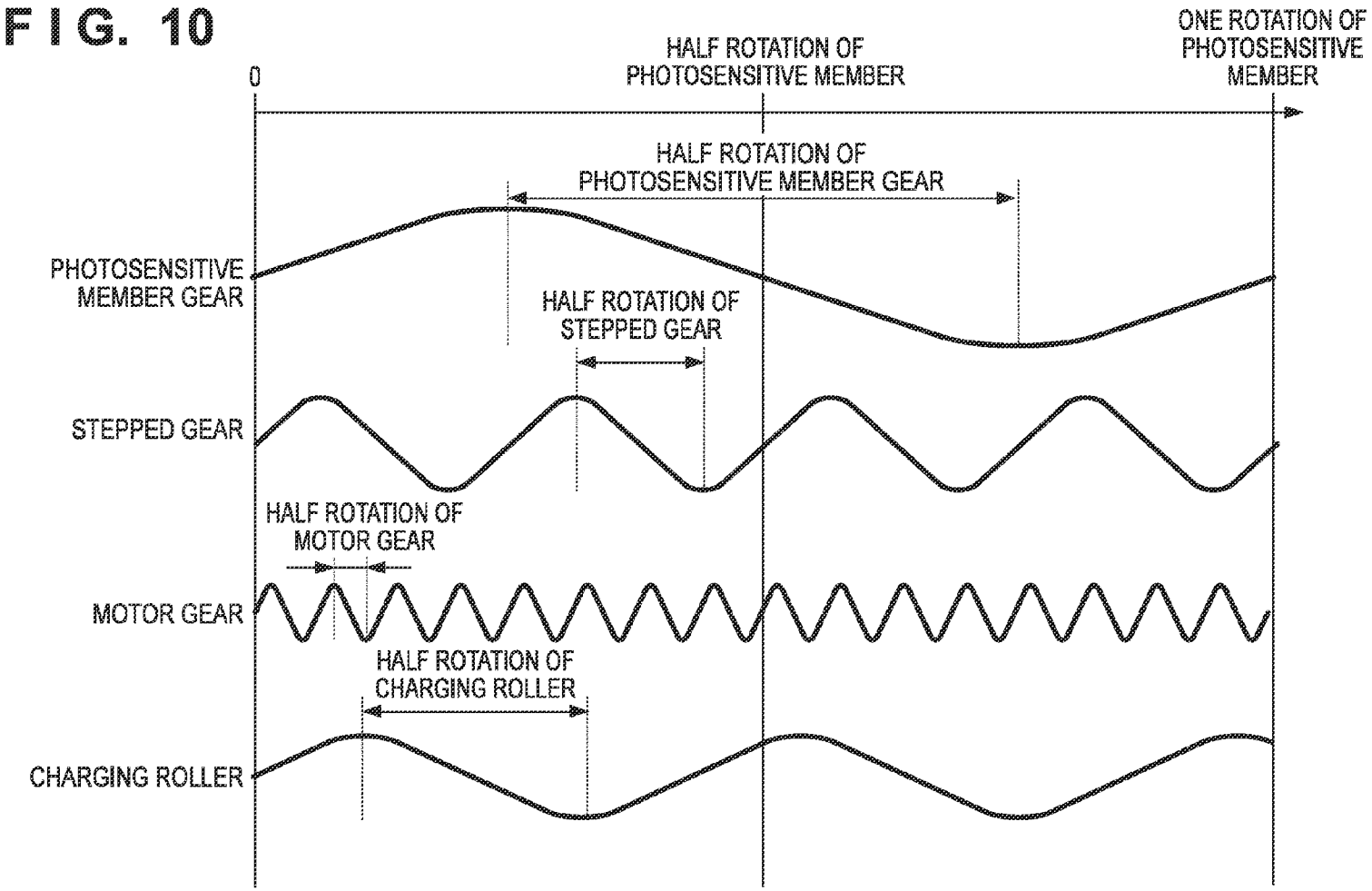
FIG. 10 depicts an illustrative diagram of speed variations that occur when a photosensitive member is driven according to one embodiment.

FIG. 10 shows a variation in the surface speed of the photosensitive member 22 due to the eccentricity of the gears. The top three waveforms in the diagram respectively indicate speed variations in the photosensitive member gear 804, the stepped gear 802 and the motor gear 801. In the gear configuration shown in FIG. 9, it has been set such that the stepped gear 802 rotates four times and the motor gear 801 rotates sixteen times during one rotation of the photosensitive member gear 804. The amplitude of the speed variation of each gear is responsive to the amount of eccentricity of the gear or the speed reduction ratio (rotation ratio) between gears. Normally, the amplitude of a gear component having a large gear diameter and a large speed reduction ratio is large. Accordingly, the speed variation of the photosensitive member gear 804 having the largest amplitude can be a component that needs to be most considered with respect to the detection error in the gear drive/transfer system.

The detection error caused by an error in the gear drive/transfer system is influenced twice:the time when a latent image pattern is formed and the time when the latent image pattern is detected. That is, depending on the relationship between the exposure position for forming a latent image mark 80 and the mounting position of the charging roller 23 that detects the latent image mark 80, the speed variation of each gear may overlap in the same phase to cause deterioration in the detection error, or may overlap in the opposite phase to cause improvement.

The AC component generated by the charging roller 23 will be described next. When the axis of rotation of the charging rollers 23 has an eccentricity, or there is an error in the shape of the roller, by an amount corresponding to the eccentricity or the error, the contact point between the charging roller 23 and the photosensitive member 22 is moved by the rounding period of the charging roller, resulting in a detection error. For example, if the axis of the charging roller 23 has an eccentricity of 50 (μm), the contact point is moved by an amount of 50 (μm), causing a detection error in the latent image pattern. The last waveform in FIG. 10 indicates a speed variation in the charging roller 23.

[Design of Basic Pattern]

In the present embodiment, the latent image pattern determined taking into consideration only the AC component will be referred to as a "basic pattern", and a pattern obtained by enhancing the basic pattern in order to increase noise resistance will be referred to as an "enhanced pattern". In the following description, it is assumed that each latent image mark 80 has a length in the sub-scanning direction corresponding to 30 lines. Here, 30 lines are substantially equal to the width of an area where the photosensitive member 22 and the charging roller 23 make contact. Also, the minimum value of the width of an area between latent image marks 80 that are adjacent to each other is also set to be 30 lines. This is because if adjacent latent image marks 80 are too close to each other, each latent image mark 80 cannot be detected correctly due to interference of the detection current. Furthermore, the sub-scanning direction of the latent image pattern, or in other words, the length in the rotational direction of the photosensitive member 22 is set to be less than or equal to the circumference of the photosensitive member 22.

A description will be given of a basic pattern for, in the case where the gear configuration is as shown in FIG. 9 and four AC components shown in FIG. 10 have occurred, reducing a detection error due to these AC components, with reference to FIG. 11. First, in order to reduce the AC component of the photosensitive member gear 804, a latent image mark 80 is added at a position spaced apart from the reference latent image mark 80 denoted by a reference numeral 11A by a half rotation of the photosensitive member gear 804. This state is denoted by a reference numeral 11B. Next, in order to reduce the AC component of the stepped gear 802, a latent image mark 80 is added at a position spaced apart from each latent image mark 80 denoted by the reference numeral 11B by a half rotation of the stepped gear 802. This state is denoted by a reference numeral 11C. Next, in order to reduce the AC component of the motor gear 801, a latent image mark 80 is added at a position spaced apart from each latent image mark 80 denoted by the reference numeral 11C by a half rotation of the motor gear 801. This state is denoted by a reference numeral 11D. Finally, in order to remove the AC component of the charging roller 23, a latent image mark 80 is added at a position spaced apart from each latent image mark 80 denoted by the reference numeral 11D by a half rotation of the charging roller 23. This state is denoted by a reference numeral 11E. In this way, it is possible to design a basic pattern including latent image marks 80 that are arranged such that the detection errors of the latent image marks caused by the four AC components cancel out each other. Then, by detecting 16 latent image marks in total and summing all of the detected values, or by dividing the summed value by the total number of latent image marks that have been formed so as to obtain an average value, the detection error due to the four AC components can be cancelled out or reduced. As described above, the basic pattern includes latent image marks 80 that are arranged at an interval of an integer fraction of the length corresponding to one period of speed variation of the gears and the charging roller 23, the number of latent image marks 80 being equal to the integer. In other words, the basic pattern includes latent image marks 80 that are arranged over one period of speed variation. Note that in the example given above, the integer is set to 2, but it may be any other value. In the case where there are a plurality of speed variations, the basic pattern includes a first number of latent image marks 80 that are arranged at an interval obtained by dividing the period of each speed variation by the first number, which is an integer.

A detection error due to a noise component will be described next. As already stated, there are cases where an abrupt position shift occurs due to electrical noise or due to the influence of the operation of the mechanical mechanism in the image forming apparatus on exposure. In the present embodiment, a detection error caused by such a position shift that occurs abruptly and randomly is simply referred to as "noise".

Figure 12A:
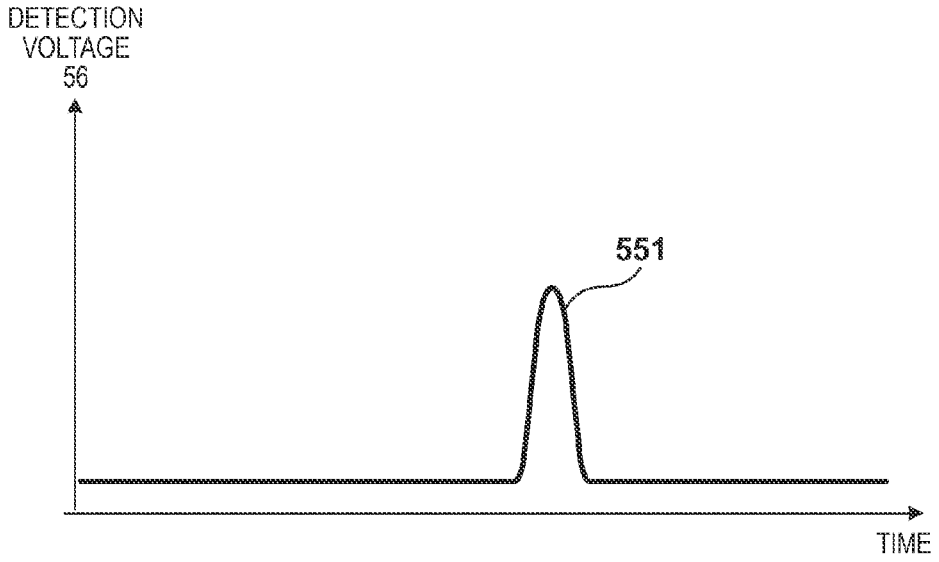
FIGS. 12A and 12B depict illustrative diagrams of a detection error caused by noise.
Figure 12B:
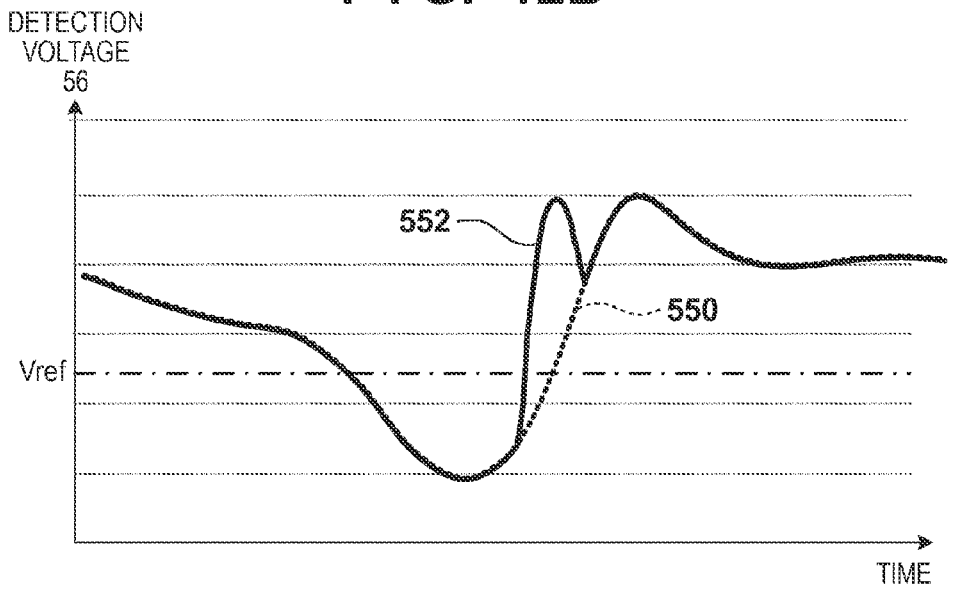

How a detection error occurs due to noise will be described with reference to FIGS. 12A and 12B. FIG. 12A shows a change in the detection voltage 56 with time. A waveform indicated by reference numeral 551 indicates electrical noise abruptly occurred during detection. When the noise 551 occurs at the timing of detection of a latent image mark, the waveform of FIG. 12A is superimposed on the waveform of FIG. 6A, and thereby a waveform 552 shown in FIG. 12B is obtained. A waveform 550 is the waveform on which noise is not superimposed. As a result of the noise being superimposed, in the detection voltage 56, the timing at which the detection voltage 56 crosses the reference voltage 75 indicated by Vref in FIG. 12B changes, which causes a detection error. The amount of detection error varies depending on the amplitude or temporal width of the noise waveform, or the timing of occurrence of noise. Note that the frequency of occurrence of noise is low, and thus in the present embodiment, the occurrence of superimposition of noise on the latent image mark 80 during a single instance of the detection operation is once at the most.

[Design of Enhanced Pattern]

Figure 13:
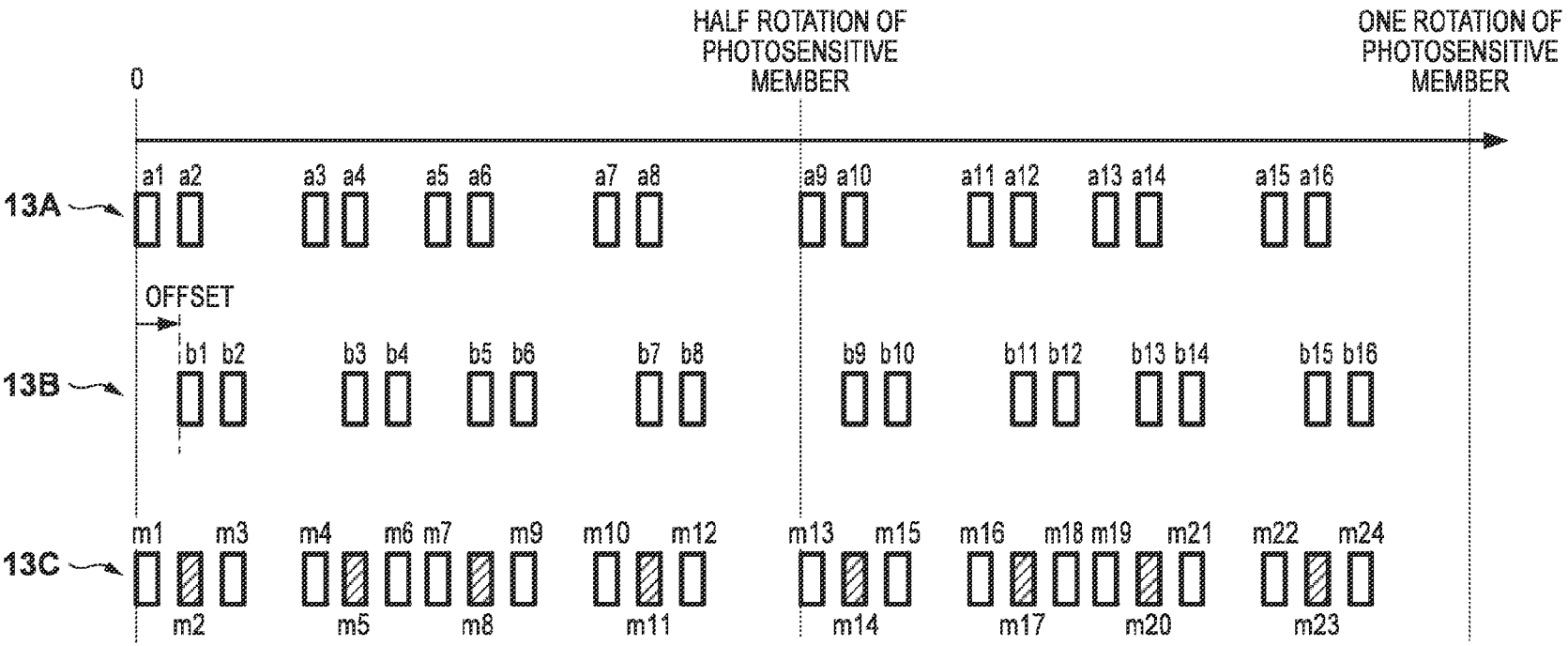
FIG. 13 depicts a diagram showing latent image patterns according to one embodiment.

Noise can be a major cause of detection error. Accordingly, in order to reduce the detection error caused by noise, increasing the number of latent image marks 80 in the basic pattern is effective. In FIG. 13, a reference numeral 13A denotes the basic pattern denoted by the reference numeral 11E of FIG. 11. In FIG. 13, a reference numeral 13B denotes a pattern obtained by offsetting the basic pattern 13A in the sub-scanning direction. The amount of offset is set such that some of the latent image marks 80 in the offset basic pattern 13B overlap some of the latent image marks 80 in the basic pattern 13A. In FIG. 13, the amount of offset is set such that latent image marks b1 , b3 , b5 , b7 , b9 , b11 , b13 and b15 in the basic pattern 13B respectively overlap latent image marks a2 , a4 , a6 , a8 , a10 , a12, a14 and a16 in the basic pattern 13A. In FIG. 13, a reference numeral 13C denotes an enhanced pattern obtained by combining the basic patterns 13A and 13B. The basic patterns 13A and 13B each include 16 latent image marks 80, but eight latent image marks 80 overlap at the same positions, and as a result, the enhanced pattern 13C includes 24 latent image marks 80.

Figure 16:
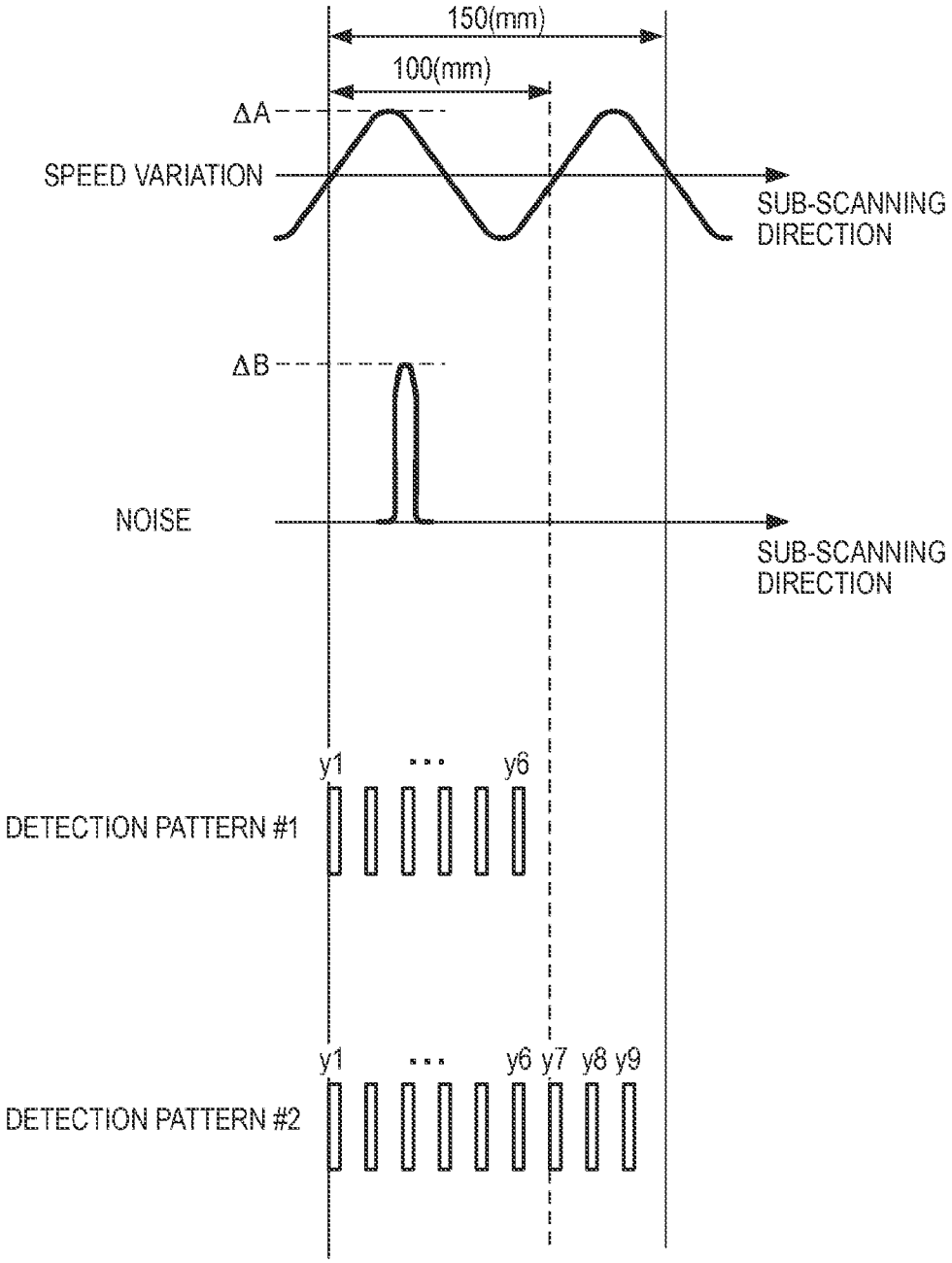
FIG. 16 depicts an illustrative diagram of restrictions on the arrangement of detection patterns.

As already explained with reference to FIG. 16, the AC components cannot be removed by simply averaging the 24 latent image marks 80. Accordingly, in the present embodiment, weighted averaging is performed.

Hereinafter, weighted averaging according to the present embodiment will be described. The enhanced pattern 13C is a pattern obtained by combining the basic patterns 13A and 13B. In each of the basic patterns 13A and 13B, by simply performing averaging processing, the AC component can be reduced. Accordingly, with respect to eight overlapping latent image marks 80, the AC component can be substantially reduced by summing twice and averaging the result. The weighting coefficient corresponds to the number of sums.

Accordingly, for example, in the enhanced pattern 13C, for a total of eight latent image marks m2 , m5 , m8 , m11 , m14 ,m17 , m20 and m23 , the weighting coefficient is set to 2 as shown in FIG. 14. For the other latent image marks, the weighting coefficient is set to 1. In this calculation, the total number of latent image marks is 32 which is the total obtained by simply adding up the latent image marks of the two basic patterns that are overlaid, rather than 24 which is the number of latent image marks that have actually been formed. Accordingly, in order to obtain the average value, it is necessary to divide the weighting coefficient by 32 . Accordingly, as shown in FIG. 14, the standardized weighting coefficient is a value obtained by dividing the weighting coefficient by 32 . With the use of the standardized weighting coefficient, the average times ty and dty from exposure to detection are determined. By using the weighting coefficient determined in the above-described manner, the detection error due to an AC component can be suppressed, and the noise component can also be suppressed to the extent possible.

Figure 11:
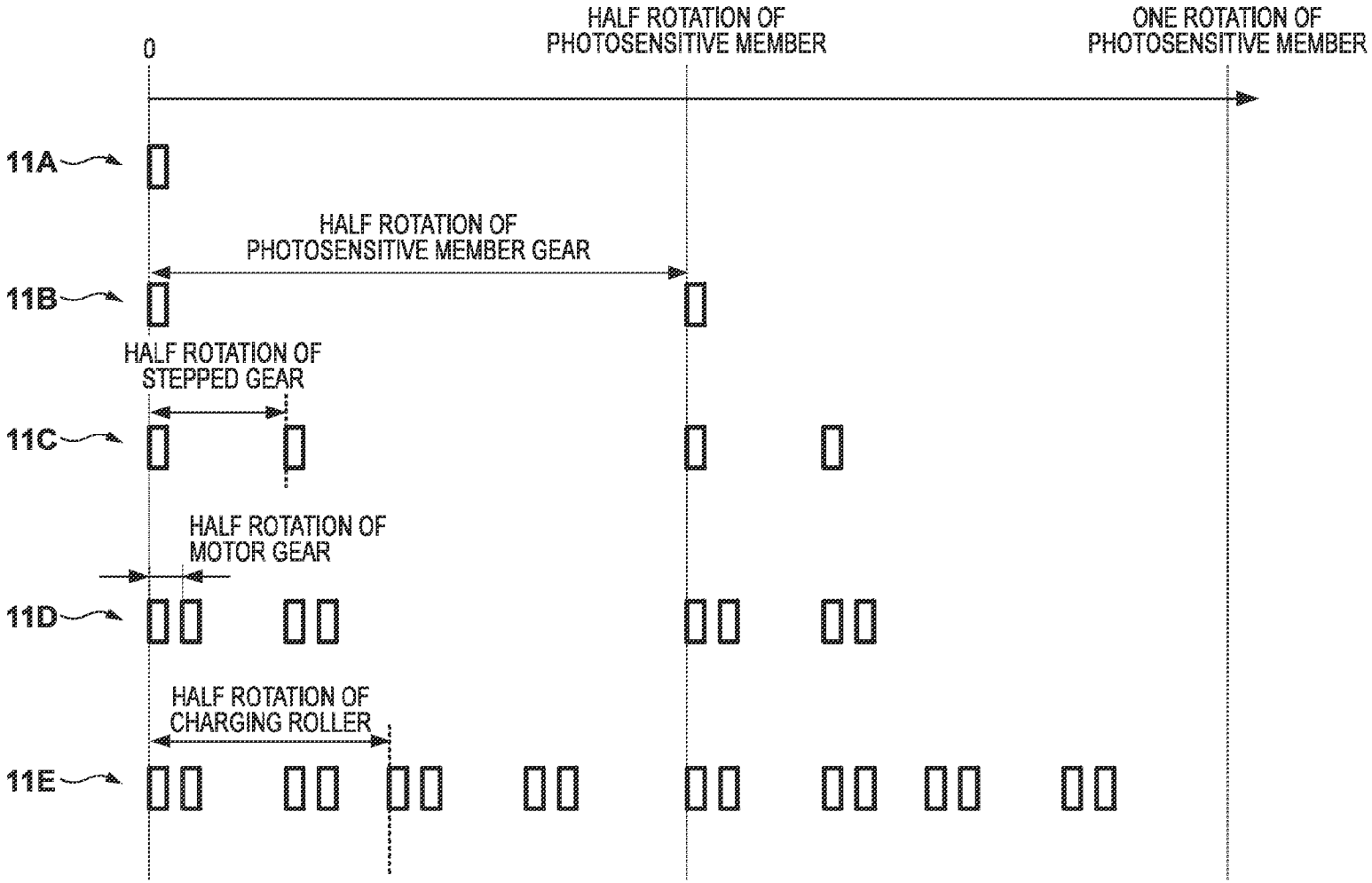
FIG. 11 depicts a diagram showing latent image patterns according to one embodiment.

For example, if noise that causes a detection error Δ is present on a single latent image mark 80, in the basic pattern 11E of FIG. 11 that includes 16 latent image marks 80, the detection error is Δ/16. In the enhanced pattern 13C to which eight latent image marks 80 are added, if noise that causes a detection error Δ is present on a single latent image mark 80, the detection error is as shown in FIG. 15. First, if noise is present on the overlapping latent image mark m2 , m5 , m8 , m11 , m14 , m17 , m20 or m23, because they are summed twice in averaging processing, the detection error is A/16. Accordingly, the detection error in this case is the same as that of the basic pattern 11E of FIG. 11. However, if noise is present on a non-overlapping latent image mark 80, the detection error is Δ/32, which is half that of the basic pattern 11E. Noise occurs at random positions, and thus the probability that noise is present on a non-overlapping latent image marks is 16/24=66.67%, which is higher than the probability that noise is present on an overlapping latent image mark 80, the probability in this case being 8/24=33.33%. Accordingly, with the enhanced pattern 13C, the resistance to noise can be increased. Also, the enhanced pattern 13C of the present embodiment can be formed so as to have a length less than twice that of the basic pattern.

In order to further improve the noise resistance, the number of overlapping latent image marks may be reduced. In other words, the ratio of overlapping latent image marks in the latent image pattern may be reduced. This reduces the probability of occurrence of noise on the overlapping latent image marks and increases the probability of obtaining the noise reduction effect, as a result of which the noise resistance is further improved. Increasing the number of latent image marks is also effective. In FIG. 13, two latent image patterns are used, but three or more latent image patterns may be overlaid.

Furthermore, in FIG. 13, the basic pattern is offset in order to cause some latent image marks 80 to overlap, but if it is possible to offset the basic pattern such that the latent image marks 80 do not overlap, the number of independent latent image marks increases, and thus the error due to noise can be further reduced. In other words, the enhanced pattern may be obtained by overlaying the basic pattern such that the latent image marks 80 of the basic pattern do not overlap. However, in a configuration as shown in FIG. 13 in which it is difficult to overlay the basic pattern such that the latent image marks 80 thereof do not overlap, the noise resistance can be increased by allowing some latent image marks 80 to overlap.

By configuring the latent image pattern in the manner described above, noise resistance can be improved while reducing the AC components.

In the embodiment given above, the latent image pattern is formed assuming that there are four AC components, but there is no limitation on the number of AC components. Also, the cause of AC components is not limited to the driving configuration of the photosensitive member 22 or the eccentricity of the charging roller 23. Also, in order to reduce the AC component to the extent possible, the position of a latent image mark 80 in the basic pattern is determined based on the period of an AC component, but the position may be any other position that can reduce the AC component. Furthermore, in the embodiment given above, the same basic patterns are overlaid to form an enhanced pattern, but two or more different basic patterns may be overlaid. This is effective when there is not enough room in the arrangement space, and thus it is not possible to overlay the basic patterns in an offset manner. Furthermore, the present embodiment is applicable not only to the latent image pattern, but also to a detection pattern constituted by a developer image.

Furthermore, in the embodiment given above, the current flowing through the charging roller 23 is detected by the current detecting circuit 50 provided in the charging high voltage power supply circuit 43. However, it is also possible to provide the current detecting circuit 50 in the developing high voltage power supply circuit 44 or the primary transfer high voltage power supply circuit 46, and detect the current flowing through the developing sleeve 24 or the primary transfer roller 26.

Other Embodiments

The present invention can also be implemented by executing the following processing. Specifically, the processing is processing in which software (a program) for implementing the functions of the embodiment described above is supplied to a system or an apparatus via a network or any of various types of storage media, and a computer (or a CPU, an MPU, or the like) of the system or apparatus reads out and executes the program.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a printing medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-272469, filed on Dec. 13, 2012, which is hereby incorporated by reference herein in its entirety.

What is claimed is:

1. An image forming apparatus comprising:

a photosensitive member;

a process unit configured to act on the photosensitive member;

a forming unit configured to form a detection pattern including a plurality of latent image marks that are electrostatic latent images for color misalignment correction on the photosensitive member;

a detecting unit configured to detect the electrostatic latent images formed on the photosensitive member;

a color misalignment correcting unit configured to perform color misalignment correction based on time information obtained by detecting, by the detecting unit, the detection pattern including the plurality of latent image marks that are electrostatic latent images for color misalignment correction; and a storage unit configured to store a weighting coefficient of each latent image mark of the detection pattern, wherein the color misalignment correcting unit is further configured to weight the time information by using the corresponding weighting coefficient and perform color misalignment correction.

2. The image forming apparatus according to claim 1, wherein the detection pattern is a pattern formed by combining a plurality of basic patterns each including a plurality of latent image marks, the basic patterns each include a first number of latent image marks that are arranged at an interval obtained by dividing at least one period of one or more periodic speed variations that occur in rotation of the photosensitive member or the processing unit by the first number.

3. The image forming apparatus according to claim 1, wherein the detection pattern is a pattern formed by combining a plurality of basic patterns each including a plurality of latent image marks, the plurality of latent image marks included in each of the basic patterns are arranged such that detection errors that occur in the time information detected from each latent image mark due to at least one of one or more periodic speed variations that occur in rotation of the photosensitive member or the processing unit cancel out each other.

4. The image forming apparatus according to claim 2, wherein the detection pattern is a pattern formed by combining the plurality of basic patterns such that their latent image marks do not overlap.

5. The image forming apparatus according to claim 2, wherein the detection pattern is a pattern formed by combining the plurality of basic patterns such that some of their latent image marks overlap with each other.

6. The image forming apparatus according to claim 5, wherein the weighting coefficient of each latent image mark is determined by the number of latent image marks overlapped when the basic patterns are combined.

7. The image forming apparatus according to claim 1, wherein a length of the detection pattern in a rotational direction of the photosensitive member is less than or equal to a circumference of the photosensitive member.

8. The image forming apparatus according to claim 1, wherein the time information is a time taken from when a latent image mark is formed by the forming unit to when the latent image mark is detected by the detecting unit.

9. The image forming apparatus according to claim 1, wherein the color misalignment correcting unit is further configured to calculate an amount of color misalignment by comparing the weighted time information with a reference value.

10. The image forming apparatus according to claim 1, wherein the processing unit is a charging unit that charges the photosensitive member, a developing unit that supplies a developing material to the electrostatic latent image on the photosensitive member, or a transferring unit that transfers a developer image formed on the photosensitive member onto another member.

11. An image forming apparatus comprising:

a photosensitive member;

a process unit configured to act on the photosensitive member;

a forming unit configured to form a detection pattern including a plurality of latent image marks that are electrostatic latent images for color misalignment correction on the photosensitive member;

a detecting unit configured to detect the electrostatic latent images formed on the photosensitive member; and a color misalignment correcting unit configured to perform color misalignment correction based on time information obtained by detecting, by the detecting unit, the detection pattern including the plurality of latent image marks that are electrostatic latent images for color misalignment correction, wherein the detection pattern is a pattern formed by combining a plurality of basic patterns each including a plurality of latent image marks, the basic patterns each include a first number of latent image marks that are arranged at an interval obtained by dividing at least one period of one or more periodic speed variations that occur in rotation of the photosensitive member or the process unit by the first number.

12. The image forming apparatus according to claim 11, wherein the plurality of latent image marks included in each of the basic patterns are arranged such that detection errors that occur in the time information detected from each latent image mark due to at least one of one or more periodic speed variations that occur in rotation of the photosensitive member or the processing unit cancel out each other.

13. The image forming apparatus according to claim 11, wherein the detection pattern is a pattern formed by combining the plurality of basic patterns such that their latent image marks do not overlap.

14. The image forming apparatus according to claim 11, wherein the detection pattern is a pattern formed by combining the plurality of basic patterns such that some of their latent image marks overlap with each other.

15. The image forming apparatus according to claim 11, further comprising a storage unit configured to store a weighting coefficient of each latent image mark of the detection pattern, wherein the color misalignment correcting unit is further configured to perform color misalignment correction by weighting the time information by using the corresponding weighting coefficient.

* * * * *